US009447699B2

(12) United States Patent
Gaida et al.

(10) Patent No.: US 9,447,699 B2
(45) Date of Patent: Sep. 20, 2016

(54) STEAM TURBINE HOUSING

(75) Inventors: Andre Gaida, Bottrop (DE); Zsolt Konya, Budapest (HU); Martin Kuhn, Neuss (DE); Frank Sperla, Oberhausen (DE)

(73) Assignee: Siemens Aktiengesellschaft, Munich (DE)

( * ) Notice: Subject to any disclaimer, the term of this patent is extended or adjusted under 35 U.S.C. 154(b) by 420 days.

(21) Appl. No.: 14/131,477

(22) PCT Filed: Jun. 14, 2012

(86) PCT No.: PCT/EP2012/061264

§ 371 (c)(1),
(2), (4) Date: Jan. 8, 2014

(87) PCT Pub. No.: WO2013/010727

PCT Pub. Date: Jan. 24, 2013

(65) Prior Publication Data

US 2014/0161608 A1 Jun. 12, 2014

(30) Foreign Application Priority Data

Jul. 15, 2011 (EP) ..... 11174163

(51) Int. Cl.

| | |
|---|---|
| ***F01D 25/24*** | (2006.01) |
| ***F01D 25/28*** | (2006.01) |
| ***F01D 25/30*** | (2006.01) |
| ***F01D 25/26*** | (2006.01) |

(52) U.S. Cl.

CPC ..... *F01D 25/243* (2013.01); *F01D 25/24* (2013.01); *F01D 25/26* (2013.01); *F01D 25/28* (2013.01); *F01D 25/30* (2013.01)

(58) Field of Classification Search

None

See application file for complete search history.

(56) References Cited

U.S. PATENT DOCUMENTS

| | | | | |
|---|---|---|---|---|
| 4,557,113 | A | 12/1985 | Silvestri, Jr. et al. | |
| 4,863,341 | A * | 9/1989 | Groenendaal | F01D 25/26 415/103 |

(Continued)

FOREIGN PATENT DOCUMENTS

| | | | |
|---|---|---|---|
| CN | 101519983 | A | 9/2009 |
| EP | 2096259 | A2 | 9/2009 |
| JP | 61019906 | A | 1/1986 |
| JP | 4365905 | A | 12/1992 |
| JP | 11093616 | A | 4/1999 |

(Continued)

*Primary Examiner* — Ninh H Nguyen
*Assistant Examiner* — Justin Seabe
(74) *Attorney, Agent, or Firm* — Beusse Wolter Sanks & Maire

(57) ABSTRACT

A steam turbine housing is provided having a housing wall and a stiffening cradle attached to the inner side which has two encircling inner webs which are arranged axially adjacent to one another and which project radially inward from the housing wall. Between the inner webs, running parallel and axially centrally, a central web is attached to the inner side of the housing wall, the radially inner edge of which is straight, wherein at the radially inner edge of the central web, the central web forks in a Y-shaped manner inward into two transition webs which extend to and merge into the adjacent inner web, such that the inner webs are fastened directly to the housing wall outside the circumferential extent of the transition webs and are fastened to the housing wall via the transition webs and the central web within the circumferential extent of the transition webs.

12 Claims, 6 Drawing Sheets

(56) References Cited

U.S. PATENT DOCUMENTS

| | | | |
|---|---|---|---|
| 5,174,120 | A | 12/1992 | Silvestri, Jr. |
| 8,172,528 | B2 | 5/2012 | Iwai |
| 8,347,499 | B2 | 1/2013 | Fischer |
| 8,403,628 | B2 | 3/2013 | Overbaugh, Jr. |
| 2005/0063821 | A1 | 3/2005 | Cantelupe |
| 2008/0213091 | A1 | 9/2008 | Fischer |

FOREIGN PATENT DOCUMENTS

| | | | |
|---|---|---|---|
| JP | 2004150357 | A | 5/2004 |
| JP | 2006017015 | A | 1/2006 |
| JP | 2006307738 | A | 11/2006 |
| JP | 2008240725 | A1 | 10/2008 |
| JP | 2009121477 | A | 6/2009 |
| JP | 2011127592 | A | 6/2011 |

* cited by examiner

STEAM TURBINE HOUSING

CROSS REFERENCE TO RELATED APPLICATIONS

This application is the US National Stage of International Application No. PCT/EP2012/061264 filed Jun. 14, 2012, and claims the benefit thereof. The International Application claims the benefit of European Application No. EP11174163 filed Jul. 15, 2011. All of the applications are incorporated by reference herein in their entirety.

FIELD OF INVENTION

The invention relates to a steam turbine housing and to a steam turbine having the steam turbine housing.

BACKGROUND OF INVENTION

In a power plant, a generator is provided for generating electricity and is for example driven by a fluid energy machine. The fluid energy machine is a steam turbine or a gas turbine used in combination with a steam turbine. A power plant driven purely by a steam turbine (steam power plant, SPP) is conventionally used to provide base-load capacity, whereas a power plant driven by gas and steam (combined cycle power plant, CCPP) is started up and shut down as required for peak loads. In accordance with conventional power plant configurations, the steam turbine for a CCPP is characterized in that it is subjected to a high cyclic load, no takeoff being provided at the steam turbine. Contrary to this, in a conventional steam power plant, the cyclic load on the steam turbine is slight, a takeoff being provided at the steam turbine. The configuration of the CCPP steam turbine is therefore different to that of the SPP steam turbine.

Steam turbines conventionally have a low-pressure turbine whose inner housing is embodied as a welded construction. On account of the different strength requirements and design with respect to the takeoff to be provided in the case of the SPP steam turbine, the construction of the inner housing for the CCPP steam turbine is different to that of the inner housing for the SPP steam turbine. A stiffening cradle is conventionally provided at the takeoff point of the inner housing for the SPP steam turbine. Such a stiffening cradle need not be provided in the inner housing for a CCPP steam turbine as the CCPP steam turbine is not fitted with a takeoff. In addition, providing the stiffening cradle in the inner housing of the CCPP steam turbine would be disadvantageous as the stiffening cradle has, as a consequence of its construction, only a limited capacity for alternating loading, whereby the stiffening cradle, if provided in the inner housing of the CCPP steam turbine, would not be able to withstand the high cyclic loads. A different welded construction to that of the inner housing of the SPP steam turbine is therefore made available for the inner housing of the CCPP steam turbine. As a consequence, when producing steam turbines, the inner housing for the CCPP steam turbine and the inner housing for the SPP steam turbine are produced separately, wherein both inner housings are kept in corresponding storage. This, however, has the drawback that separate production with corresponding storage must be provided for both the SPP steam turbine and the CCPP steam turbine.

SUMMARY OF INVENTION

An object herein is to specify a steam turbine housing which is suitable for both a CCPP steam turbine and an SPP steam turbine.

The steam turbine housing herein has a housing wall, to the inside of which is attached a stiffening cradle having two circumferential inner webs arranged axially next to one another and projecting radially inward from the housing wall, a central web being attached to the inside of the housing wall between the inner webs so as to run parallel to these and axially centrally, the radially inner rim of the central web being straight so that the longitudinal ends of this rim meet the housing wall, with the circumferential extent of the central web thus being defined, wherein the central web forks, at its inner rim, in the shape of an inward-facing Y to form two transition webs which in each case extend as far as the adjacent inner web and merge into the latter, such that, outside the circumferential extent of the transition webs, the inner webs are attached to the housing wall directly, while inside the circumferential extent of the transition webs they are attached to the housing wall via the transition webs and the central web.

As the stiffening cradle is constructed with the central web in accordance with the invention, the stiffening cradle has a high cyclic load capacity. As a result, the steam turbine housing of the invention, with its stiffening cradle, can be used not only in an SPP steam turbine but also in a CCPP steam turbine in which the stiffening cradle is subjected to a high cyclic load. An advantageous consequence of this is the possibility of providing the steam turbine housing for both the SPP steam turbine and the CCPP steam turbine as the steam turbine housing is suitable for both steam turbine types. In a subsequent production step, the steam turbine housing can be made ready for use with the SPP steam turbine in that, for example, supply pipes are built onto the steam turbine housing. The supply pipes are preferably arranged in the region of the central web.

In order to produce SPP steam turbines and CCPP steam turbines, it is possible, with the steam turbine housing of the invention, to provide a "neutral housing" which is suitable for both steam turbine types. The "neutral housing" preferably has a geometry corresponding to a conventional CCPP steam turbine housing and is fitted with the stiffening cradle of the invention. The steam turbine housing can then be installed, without conversion and thus directly, in a CCPP steam turbine. If the steam turbine housing is installed in an SPP steam turbine, all that is necessary in the subsequent conversion is to attach corresponding takeoff pipes to the steam turbine housing. The effort involved in the subsequent conversion is low compared to that which would arise if separate steam turbine housings were to be produced and kept ready for both the CCPP steam turbine and the SPP steam turbine. In addition, the steam turbine housing of the invention has the advantage that the steam turbine housing can be produced in greater numbers as the steam turbine housing is suitable for both the CCPP steam turbine and the SPP steam turbine. The stiffening cradle is equipped, with its construction according to the invention, such that it can withstand the high cyclic loads in a CCPP steam turbine.

The inner rim of the central web preferably has a kink point, straight rim sections of the inner rim extending from this kink point as far as the housing wall. The inner rim of the central web preferably has a concave profile at the kink point, wherein the spread angle between the rim sections at the kink point is preferably between 150° and 155°.

The tangential extent of the central web from the kink point is preferably between 12 times and 20 times the radial extent of the central web at the kink point. The radial extent of the transition webs at the kink point is preferably between three times and seven times the radial extent of the central web at the kink point. It is further preferred if the ratio of the thicknesses of the transition webs to the housing wall thickness is between 0.8 and 1.2. The transition webs preferably have, at the inner rim of the central web, an opening angle of between 68° and 85°.

The stiffening cradle preferably has two circumferential outer webs arranged axially next to one another and projecting radially inward from the housing wall, the inner webs being provided between the outer webs so as to run parallel to these and axially centrally, wherein the outer webs are inclined in the axial direction toward the inner webs. It is further preferred for the inner webs to be inclined in the axial direction so as to be parallel to their adjacent outer webs.

The steam turbine housing is preferably a welded construction. It is further preferred for the steam turbine housing to be a low-pressure turbine inner housing.

BRIEF DESCRIPTION OF THE DRAWINGS

A preferred embodiment of a steam turbine housing according to the invention is described below with reference to the appended schematic drawings, in which.

DETAILED DESCRIPTION OF INVENTION

Figure 1:
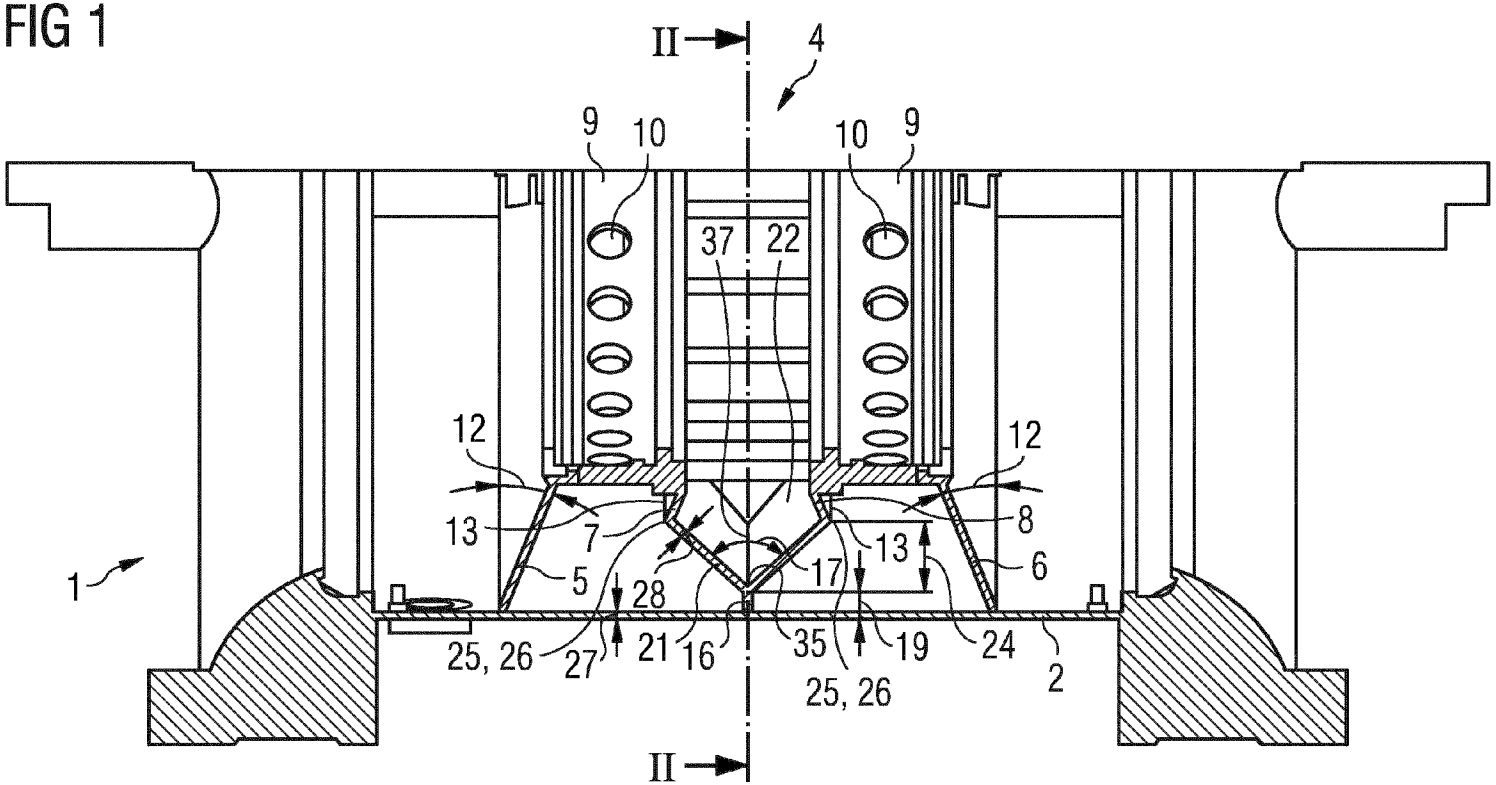
FIG. 1 is a longitudinal section, through I-I of FIG. 2, of the embodiment of the steam turbine housing according to the invention.
Figure 2:
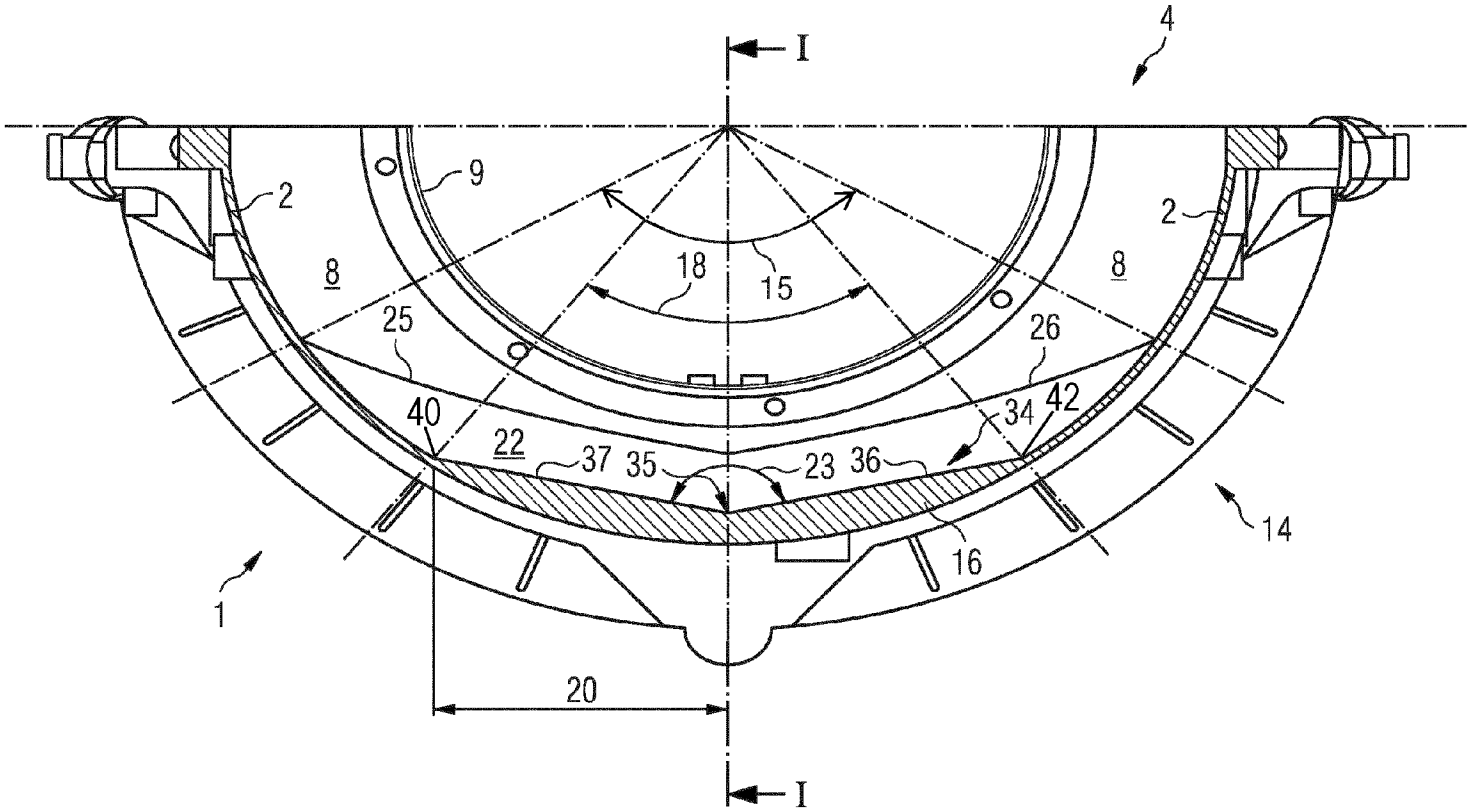
FIG. 2 is a transverse section, through II-II of FIG. 1, of the embodiment of the steam turbine housing according to the invention.
Figure 5:
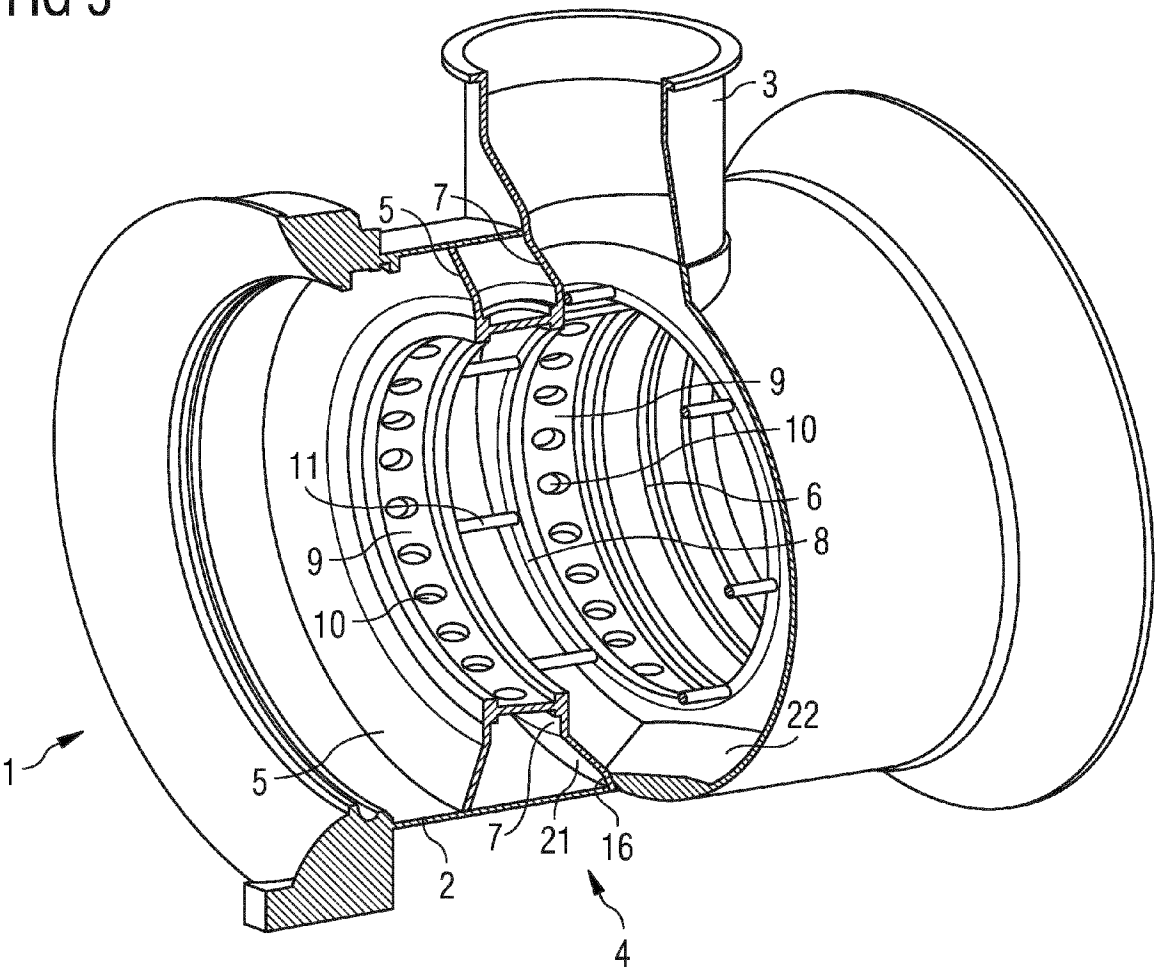
FIG. 5 is a three-dimensional section view of the embodiment of the steam turbine housing according to the invention.

As can be seen in FIGS. 1 and 5, a steam turbine housing 1 has a housing wall 2. A pipe 3 is provided on the steam turbine housing 1. A circumferentially symmetric stiffening cradle 4 is built onto the inside of the housing wall 2.

The stiffening cradle 4 has a first outer web 5 and a second outer web 6, wherein the outer webs 5, 6 delimit the axial extent of the stiffening cradle 4. The outer webs 5, 6 are attached to the inside of the housing wall 2 and project radially inward into the steam turbine housing 1. The stiffening cradle 4 further has a first inner web 7 and a second inner web 8, wherein the inner webs extend over the circumference of the steam turbine housing 1 and are arranged between the outer webs 5, 6. As with the outer webs 5, 6, the inner webs 7, 8 project radially inward into the steam turbine housing 1, wherein the inner radius of the outer webs 5, 6 and of the inner webs 7, 8 is the same. A cylindrical hole strip 9, having a row of holes which is formed by multiple holes 10 and which extends around the circumference, is provided between the first outer web 5 and the first inner web 7 at the radially inner rims of the first outer web 5 and the first inner web 7. In analogous fashion, a hole strip 9 having multiple holes 10 is also provided on the second outer web 6 and the second inner web 8. The inner webs 7, 8 are arranged separated from each other in the axial direction, this separation being bridged by multiple tie rods 11 arranged over the circumference.

The outer webs 5, 6 are arranged inclined toward each other when seen in the radially inward direction, wherein the outer webs 5, 6 have an outer web inclination angle 12. The first inner web 7 is arranged inclined parallel to the first outer web 5 and the second inner web 8 is arranged inclined parallel to the second outer web 6, such that the inner webs 7, 8 have an inner web inclination angle 13. The outer web inclination angle 12 and the inner web inclination angle 13 are thus of identical magnitude.

The inner webs 7, 8 each have a stiffening segment 14 having a stiffening segment angle 15 between 90° and 180°, in this case 120°. Outside the stiffening segment 14, the inner webs 7, 8 are attached to the housing wall 2. Inside the stiffening segment 14, the stiffening cradle 4 has a central web 16 which is arranged centrally between the inner webs 7, 8 and attached to the inside of the housing wall 2, projecting radially inward therefrom. On the radially inward side, the central web 16 forks radially inward in a Y shape and merges into a first transition web 21 and a second transition web 22, wherein the transition webs 21, 22 enclose a central opening angle 17. The central opening angle 17 is between 68° and 85°.

Central web 16 extends in the circumferential direction and encompasses the central segment angle 18 which is between 30° and 90°, in this case 70°.

The central web 16 has, at its mid-point, a kink point 35, a first rim section 36 and a second rim section 37 extending therefrom. The central web 16 has a radially inner rim 34 formed by the first rim section 36 and the second rim section 37. The rim sections 36, 37 form the radially inner limit of the central web 16, the rim sections 36, 37 being straight, and longitudinal ends 40, 42 of the radially inner rim 34 meet the housing wall 2. The rim sections 36, 37 form secants arranged symmetrically either side of the radial direction of the kink point 35. At the kink point 35, the rim sections 36, 37 form, with respect to each other, a spread angle 23 less than 180°. The rim sections 36, 37 thus give the inner rim of the central web 16 a concave profile over the circumference. At the kink point 35, the central web 16 has a central web height 19 and the extent of the rim sections 36, 37 perpendicular to the radial direction of the kink point 35 is termed central web breadth 20. The ratio of the central web breadth 20 to the central web height 19 is between 12 and 20.

The transition webs 21, 22 run radially inward from the rim sections 36, 37 of the central web 16 and are inclined with respect to each other by the central web opening angle 17 and merge into the inner webs 7, 8, the first transition web 21 merging into the first inner web 7 and the second transition web 22 merging into the second inner web 8. At the kink point 35, as seen in the radially inward direction, the height of the transition webs 21, 22 is a transition web height 24, wherein the ratio of the transition web height 24 to the central web height 19 is between 4 and 8.

Radially inward from the first rim section 36, the transition webs 21, 22 form, on the inner webs 7, 8, a first intersection edge 25 and, from the second rim section 37, the transition webs 21, 22 form, on the inner webs 7, 8, a second intersection edge 26. As the rim sections 36, 37 are straight, the transition webs 21, 22 are in the form of plates and have, symmetrically with respect to the spread angle 23, a kink at the kink point 35. Since the transition webs 21, 22 merge into the inner webs 7, 8 at the intersection edges 25, 26, the intersection edges 25, 26 are arcuate.

The housing wall 2 has a housing wall thickness 27 and the transition webs 21, 22 have a transition web thickness 28, the ratio of the transition web thickness 28 to the housing wall thickness 27 being between 0.8 and 1.2.

Figure 3:
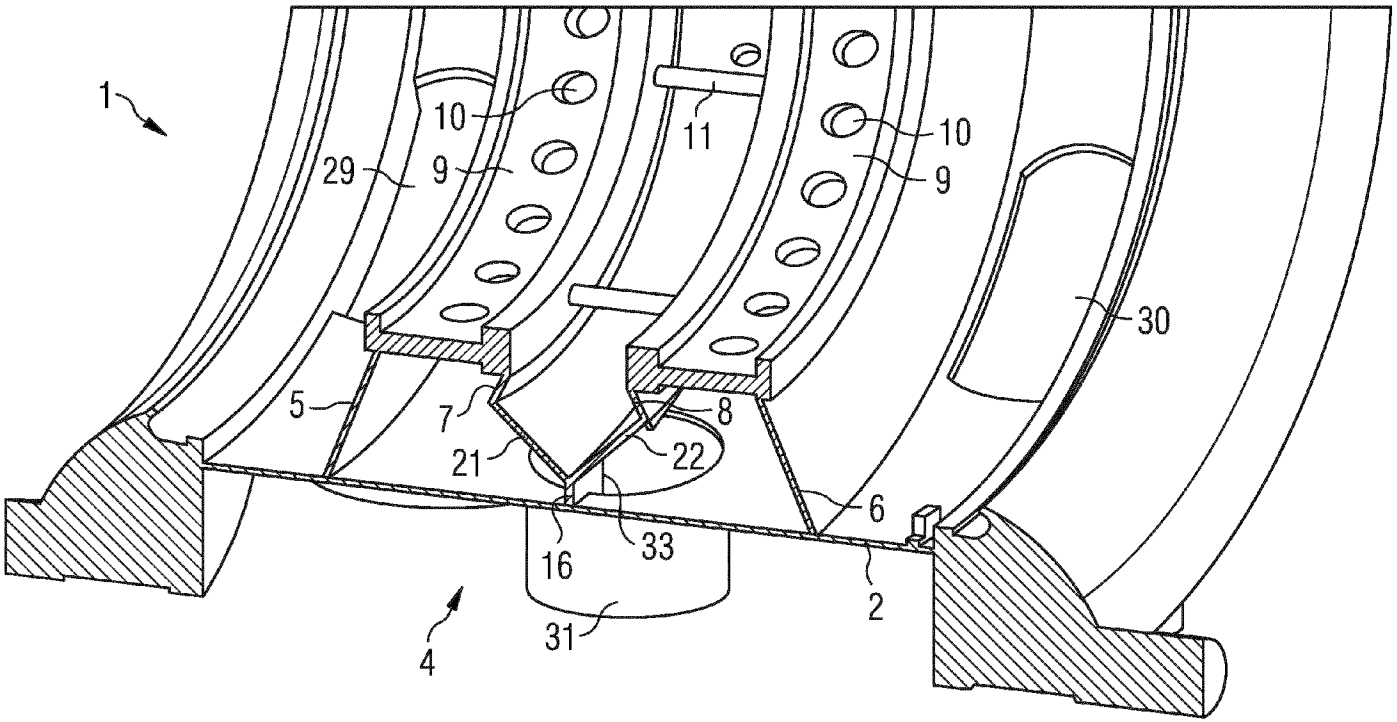
FIGS. 3, 4 are three-dimensional section views of an SPP steam turbine housing formed from the embodiment of the steam turbine housing according to the invention.
Figure 4:
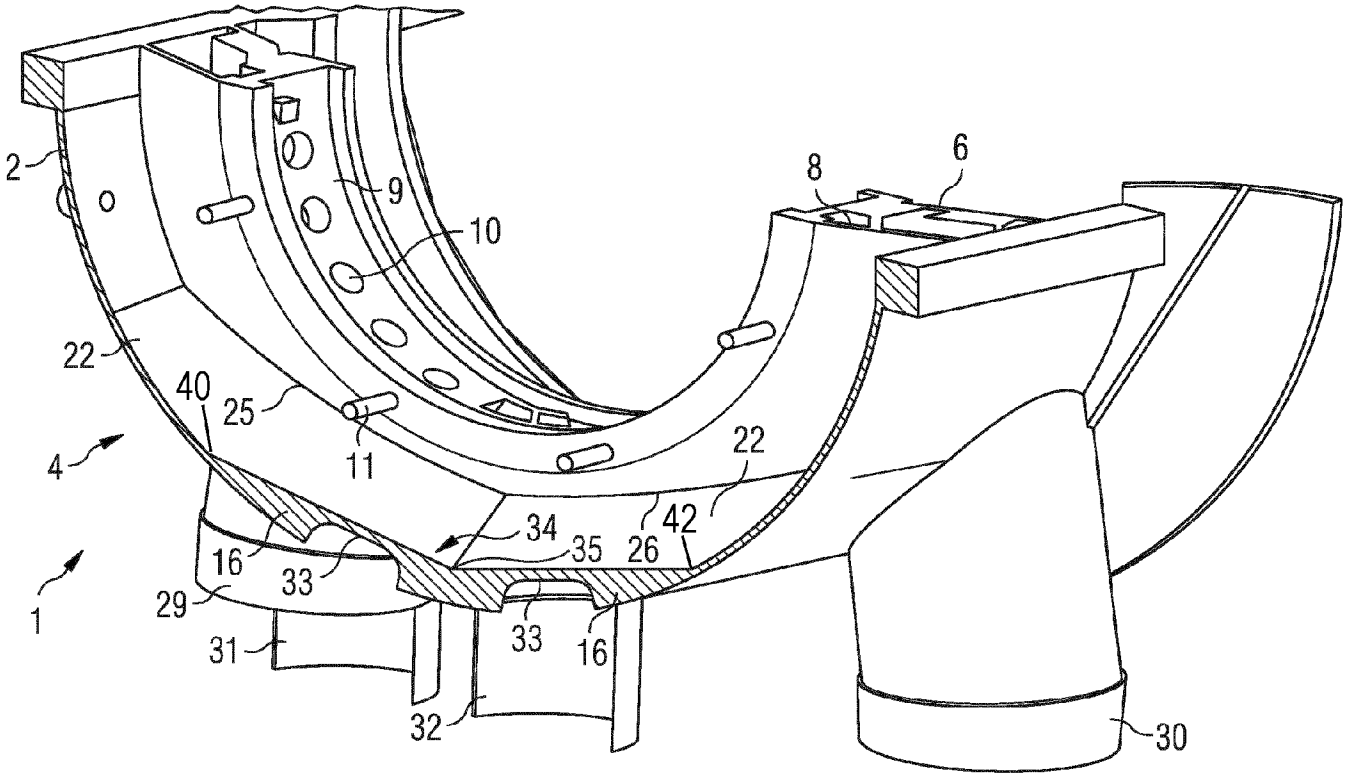

FIGS. 3 and 4 show the steam turbine housing 1 with subsequently built-on takeoff pipes 29 to 32. For the third takeoff pipe 31, attached radially outside the central web 16, a central web cutout 33 is provided in the central web 16.

Figure 6:
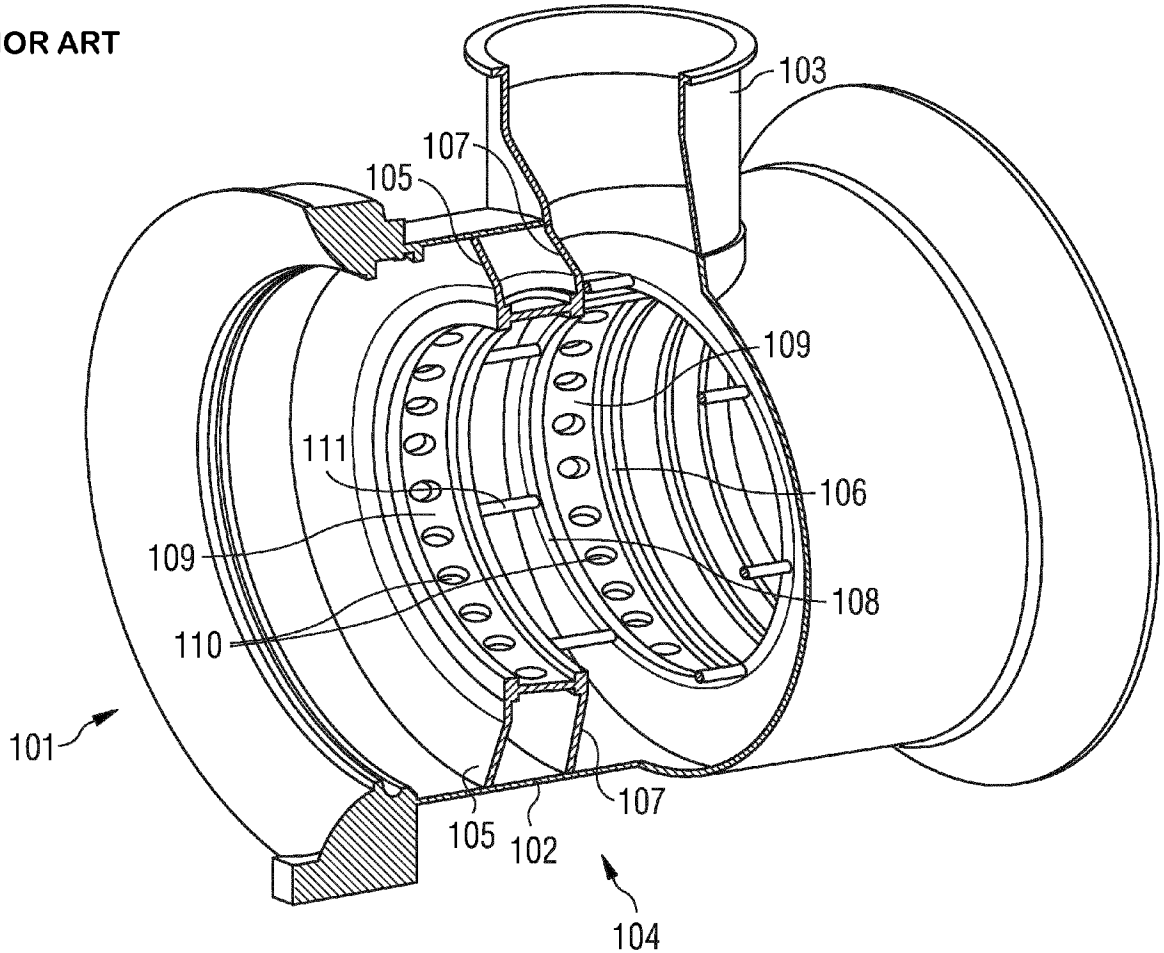
FIG 6 PRIOR ART
FIG. 6 is a three-dimensional section view of a conventional steam turbine housing.

FIG. 6 shows a conventional steam turbine housing 101 having a housing wall 102. A pipe 103 is attached to the steam turbine housing 101. A stiffening cradle 104 is provided in the steam turbine housing 101, on the radially inward side of the housing wall 102. The stiffening cradle 104 has a first outer web 105, a second outer web 106, a first inner web 107 and a second inner web 108. The outer webs 105, 106 and the inner webs 107, 108 are fastened to the radially inward side of the housing wall 102 such that they are parallel to each other and run around the housing wall 102. A hole strip 109 having multiple circumferential holes 110 is provided in each case between the first outer web 105 and the first inner web 107 and between the second outer web 106 and the second inner web 108. The inner webs 107, 108 are arranged separated from each other in the axial direction, this separation being bridged by multiple tie rods 111 arranged evenly around the circumference. The outer webs 105, 106 and the inner webs 107, 108 are arranged parallel to each other and at right angles to the housing wall 102.

The invention claimed is:

1. A steam turbine housing comprising:

a housing wall, to a radially inside of which is attached a stiffening cradle having two circumferential inner webs arranged axially next to one another and projecting radially inward from the housing wall, a central web being attached to the radially inside of the housing wall between the inner webs so as to run parallel to and axially centrally of the inner webs, a radially inner rim of the central web being straight so that longitudinal ends of the radially inner rim meet the housing wall, defining a circumferential extent of the central web, wherein the central web forks, at the radially inner rim, in a radially inward-facing Y-shape to form two transition webs which in each case extend as far as the adjacent inner web and merge into the adjacent inner web, such that, outside a circumferential extent of the transition webs, the inner webs are attached to the housing wall directly, while inside the circumferential extent of the transition webs the inner webs are attached to the housing wall via the transition webs and the central web.

2. The steam turbine housing as claimed in claim 1, wherein the radially inner rim of the central web has a kink point, straight rim sections of the inner rim extending from this kink point as far as the housing wall.

3. The steam turbine housing as claimed in claim 2, wherein the radially inner rim of the central web has a concave profile at the kink point.

4. The steam turbine housing as claimed in claim 3, wherein a spread angle measured between the rim sections at the kink point is between 150° and 155°.

5. The steam turbine housing as claimed in claim 2, wherein a tangential extent perpendicular to the radial direction of the central web measured from the kink point to the respective longitudinal end is between 12 times and 20 times in length a radial extent of the central web at the kink point.

6. The steam turbine housing as claimed in claim 2, wherein a radial extent of the transition webs at the kink point is between three times and seven times in length the radial extent of the central web at the kink point.

7. The steam turbine housing as claimed in claim 1, wherein the value of a ratio of thicknesses of the transition webs to a housing wall thickness is between 0.8 and 1.2.

8. The steam turbine housing as claimed in claim 1, wherein the transition webs have, at the radially inner rim of the central web, an opening angle of ranging from 68° to 85°, the opening angle defined between the transition webs.

9. The steam turbine housing as claimed in claim 1, wherein the stiffening cradle has two circumferential outer webs arranged axially next to one another and projecting radially inward from the housing wall, the inner webs being provided between the outer webs so as to run parallel to these and axially centrally, wherein the outer webs are inclined in the axial direction toward the inner webs.

10. The steam turbine housing as claimed in claim 9, wherein the inner webs are inclined in the axial direction so as to be parallel to their adjacent outer webs.

11. A steam turbine having a steam turbine housing as claimed in claim 1, wherein the steam turbine housing is a welded construction.

12. The steam turbine as claimed in claim 11, wherein the steam turbine housing is a low-pressure turbine inner housing.

* * * * *